US009310743B2

(12) United States Patent
Shiraishi et al.

(10) Patent No.: US 9,310,743 B2
(45) Date of Patent: Apr. 12, 2016

(54) IMAGE FORMING APPARATUS AND CLEANING OF IMAGE FORMING APPARATUS

(71) Applicants: Emiko Shiraishi, Tokyo (JP); Tadashi Kasai, Kanagawa (JP); Makoto Yasuda, Kanagawa (JP); Yuichi Aizawa, Ibaraki (JP); Mutsuki Morinaga, Kanagawa (JP); Hitoshi Yamamoto, Kanagawa (JP)

(72) Inventors: Emiko Shiraishi, Tokyo (JP); Tadashi Kasai, Kanagawa (JP); Makoto Yasuda, Kanagawa (JP); Yuichi Aizawa, Ibaraki (JP); Mutsuki Morinaga, Kanagawa (JP); Hitoshi Yamamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/325,894

(22) Filed: Jul. 8, 2014

(65) Prior Publication Data

US 2015/0037049 A1 Feb. 5, 2015

(30) Foreign Application Priority Data

Jul. 31, 2013 (JP) ..... 2013-159271

(51) Int. Cl.
*G03G 15/08* (2006.01)
*G03G 15/00* (2006.01)
*G03G 15/01* (2006.01)

(52) U.S. Cl.
CPC ..... *G03G 15/556* (2013.01); *G03G 15/0121* (2013.01)

(58) Field of Classification Search
CPC ..... G03G 15/556; G03G 15/0121; G03G 2221/1823; G03G 2215/0695; G03G 2215/0697
USPC ..... 399/12, 257
See application file for complete search history.

(56) References Cited

U.S. PATENT DOCUMENTS

2007/0263064 A1* 11/2007 Anderson ..... 347/158
2009/0269093 A1* 10/2009 Zehentbauer et al. ..... 399/53
2014/0133889 A1 5/2014 Matsumoto et al.

FOREIGN PATENT DOCUMENTS

JP 2008-151971 7/2008

OTHER PUBLICATIONS

U.S. Appl. No. 14/325,809, filed Jul. 8, 2014.
U.S. Appl. No. 14/173,104, filed Feb. 5, 2014.

* cited by examiner

*Primary Examiner* — Walter L Lindsay, Jr.
*Assistant Examiner* — Ruth Lambombard
(74) *Attorney, Agent, or Firm* — Oblon, McClelland, Maier & Neustadt, L.L.P.

(57) ABSTRACT

An image forming apparatus includes a plurality of image bearing members, replaceable development units, replaceable toner replenishing members, toner supply units, and a control unit. The development units are each provided for a corresponding one of the plurality of image bearing members. The toner replenishing members are each provided for a corresponding one of the development units. The toner supply units are arranged between the respective toner replenishing members and the development units. The control unit causes the image forming apparatus to execute a toner supply unit cleaning mode to convey a last-used toner inside the toner supply unit into the development unit which is last used and to be replaced to empty the toner supply unit, when replacement of the development unit and the corresponding toner replenishing member is designated to use a toner of a type different from the last-used toner.

18 Claims, 14 Drawing Sheets

IMAGE FORMING APPARATUS AND CLEANING OF IMAGE FORMING APPARATUS

CROSS-REFERENCE TO RELATED APPLICATIONS

This patent application is based on and claims priority pursuant to 35 U.S.C. §119 to Japanese Patent Application No. 2013-159271, filed on Jul. 31, 2013, in the Japan Patent Office, the entire disclosure of which is hereby incorporated by reference herein.

BACKGROUND OF THE INVENTION

1. Technical Field

Exemplary aspects of the present invention relate to an image forming apparatus such as a copier, a printer, a facsimile machine, a plotter, or a multi-function peripheral having at least two of copying, printing, facsimile, and plotter functions. More particularly, exemplary aspects of the present invention relate to an image forming apparatus capable of using a special color toner in addition to process color toners.

2. Description of the Related Art

Certain contemporary electrophotographic apparatuses are capable of using special toners in addition to process color toners of cyan, magenta, yellow, and black (CMYK). Such an electrophotographic apparatus includes one or more image forming stations (process units) for the special color toners in addition to four image forming stations for the respective process color toners of CMYK. Moreover, in the image forming station of the process color toner, the process color toner can be replaced with the special color toner. One of the special color toners is a clear toner (including a transparent toner, a colorless toner, an achromatic color toner, and a no-pigment toner).

For example, the electrophotographic apparatus can print color printed matter by entirely or partially overlaying the clear toner to adjust glossiness of the color printed matter. Such glossiness adjustment can generate higher value-added printed matter. Other special color toners include red (R), green, (G), and blue (B) toners. The use of such special color toners of RGB can reproduce high-quality colors that are difficult to reproduce by overlaying the CMYK process color toners. In addition to these special color toners, there is a wide variety of special color toners.

When a special color toner is used, a toner in the image forming station of the electrophotographic apparatus may need to be replaced. The toner replacement is needed in the following cases: a) where a process color toner is replaced with a special color toner; b) where a special color toner is replaced with a process color toner; c) where a special color toner is replaced with another special color toner; and d) a process color toner is replaced with another process color toner.

JP-4321583-B1 (JP-2008-151971-A) discloses an image forming method performed by an image forming apparatus including four cartridge holders, in which CMYK toner cartridges in the image forming apparatus are replaced with special color toner cartridges. Prior to the replacement, a suitable order in which toners are overlaid to form a desired image is determined. Accordingly, a user sets a suitable toner cartridge in the determined cartridge holder. When the toner cartridge is replaced, the cartridge holder reads toner attribute information provided in the toner cartridge that the image forming apparatus can use to monitor which color of toner cartridge is set in which cartridge holder. According to the image forming method disclosed in JP-4321583-B1 (JP-2008-151971-A), the image forming apparatus with such a configuration including the four process units can reproduce diverse colors difficult to reproduce by overlaying CMYK process color toners, while remaining compact.

In the method disclosed in JP-4321583-B1 (JP-2008-151971-A), since the toner cartridge (process cartridge) as a whole is replaced, different types of toners are not mixed together. That is, when the process cartridge is replaced, a development device in which developer is stored is detached from the image forming apparatus. The detachment of the development device prevents admixture of a developer of the replaced process cartridge and a developer of a replacement process cartridge.

Meanwhile, devices for replenishing toner to a development device or a development unit using a toner replenishing member are known. The toner replenishing member, called a toner bottle or a toner tank, is disposed in a position different from the development device arranged inside a process cartridge detachable to an image forming apparatus or the development unit replaceable to the image forming apparatus. The arrangement of the toner replenishing member enables the process cartridge to be compact. Moreover, replacement of the toner replenishing member can maintain appropriate life span of the process cartridge.

In the image forming apparatus employing the toner replenishing method using the toner replenishing member, however, a mixture of toners cannot be avoided where toner replacement involving a special toner is performed as described above. That is, even if the toner replenishing member and the development unit are replaced as appropriate depending on the purpose for which the toner is used, a last-used toner of a type different from that of the special toner remains in a toner replenishing path serving as a toner supply unit. Thus, if the image forming apparatus forms an image as is, the different types of toners may cause a color mixture (contamination, mixing) that is not intended by a user. Consequently, the color mixture may cause generation of an irregular image.

The color mixture may be prevented if the toner supply unit is replaced at the same time as the replacement of the toner replenishing member and the development unit. However, since the toner supply unit includes a conveyance tube, a pump, and a hopper, the replacement of the toner supply unit on each such occasion is not only a cumbersome process, but also may damage an image forming unit. Accordingly, the toner supply unit arranged between the toner replenishing member and the development unit should not be replaced from a practical standpoint.

Alternatively, an image forming apparatus may be configured to include a dedicated special toner image forming unit for each of CMYK image forming units, so that toner replacement is not needed to avoid a problem of the color mixture. However, such a configuration increases the overall size of the image forming apparatus, and limits the types of color changes that can be made by toner replacement.

Conventionally, a so-called five-station image forming apparatus is known, in which one image forming unit just for a special toner is disposed in addition to CMYK image forming units. However, in a case where two or more image forming units are to be added, a concomitant increase in size of the image forming apparatus may become a serious problem.

SUMMARY

In at least one embodiment of this disclosure, there is provided an improved image forming apparatus including a plurality of image bearing members, replaceable development units, replaceable toner replenishing members, toner supply units, and a control unit. The development units are each provided for a corresponding one of the plurality of image bearing members to render electrostatic latent images formed on the respective image bearing members visible as toner images based on image data. The toner replenishing members are each provided for a corresponding one of the development units to replenish toner to the respective development units. The toner supply units are arranged between the respective toner replenishing members and the development units. A control unit causes the image forming apparatus to execute a toner supply unit cleaning mode to convey a last-used toner inside a toner supply unit between a toner replenishing member to be replaced and a development unit to be replaced to the development unit which is last used and to be replaced to empty the toner supply unit, when replacement of the development unit and the corresponding toner replenishing member is designated to use a toner of a type different from the last-used toner.

In at least one embodiment of this disclosure, there is provided an improved image forming apparatus including a plurality of image bearing members, replaceable development units, replaceable toner replenishing members, a first toner type information detector, a second toner type information detector, and a control unit. The development units are each provided for a corresponding one of the plurality of image bearing members to render electrostatic latent images formed on the respective image bearing members visible as toner images based on image data. The toner replenishing members are each provided for a corresponding one of the development units to replenish toner to the respective development units. The first toner type information detector acquires toner type information, recorded in each of the toner replenishing members, indicating a type of toner stored in each of the toner replenishing members. The second toner type information detector to acquire toner type information, recorded in each of the development units, indicating a type of toner stored in each of the development units. The control circuit causes the image forming apparatus to not perform an image forming operation when a combination of designated toner types to form an image does not match toner types of a replaced development unit and a replaced toner replenishing member.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
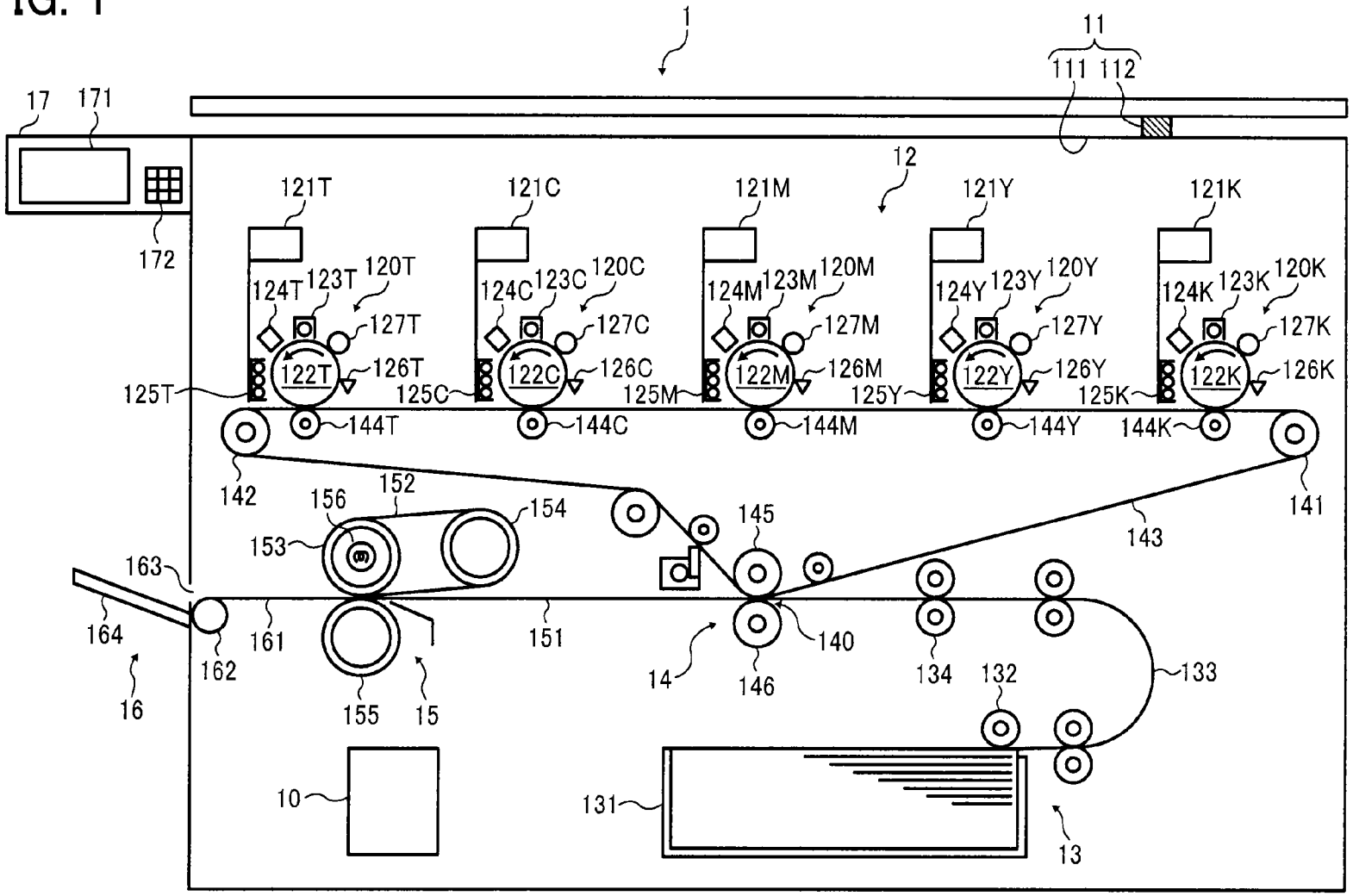
FIG. 1 is a schematic view of an image forming apparatus according to an exemplary embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF THE INVENTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

An image forming apparatus 1 according to an exemplary embodiment of the present invention is described with reference to drawings. FIG. 1 illustrates an overall configuration of the image forming apparatus 1, and FIG. 2 illustrates a configuration of a control unit 10 of the image forming apparatus 1.

The image forming apparatus 1 forms an image on a sheet of recording media by fixing a toner image on the sheet. As illustrated in FIG. 1, the image forming apparatus 1 includes the control unit 10, an image reading unit 11, an image forming unit 12, a feeding unit 13, a transfer unit 14, a fixing unit 15, a discharge unit 16, and an operation panel 17.

Figure 2:
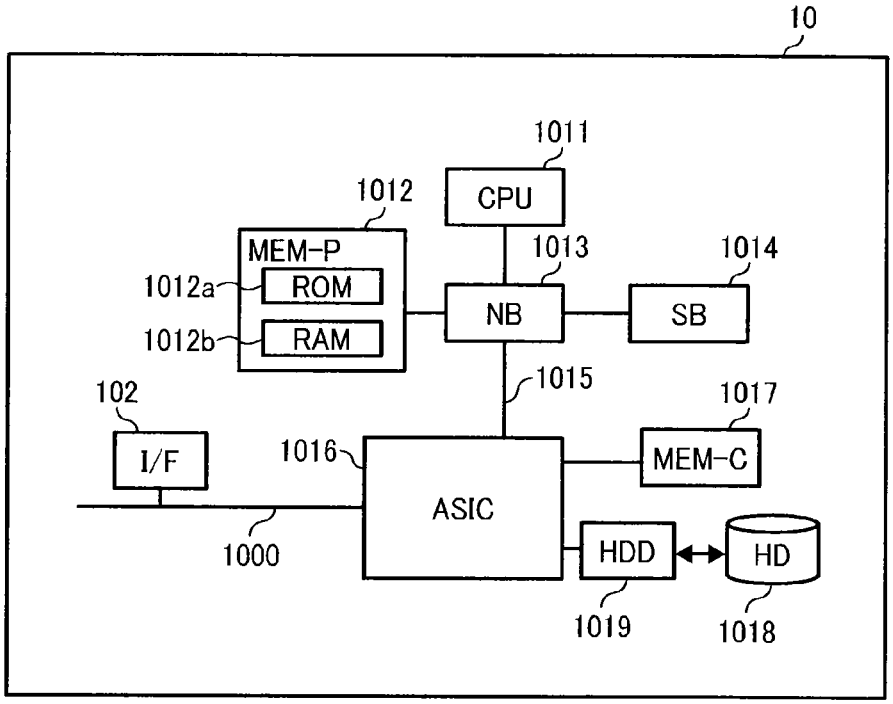
FIG. 2 is a block diagram of a control unit in the image forming apparatus shown in FIG. 1.

As illustrated in FIG. 2, the control unit 10 includes a central processing unit (CPU) 1101, a main memory (hereinafter called MEM-P) 1012, and a north bridge (NB) 1013. Moreover, the control unit 10 includes a south bridge (SB) 1014, an accelerated graphic port (AGP) bus 1015, an application specific integrated circuit (ASIC) 1016, a local memory (hereinafter called MEM-C) 1017, and a hard disk (HD) 1018. In addition, the control unit 10 includes a hard disk drive (HDD) 1019 and a network interface (I/F) 102.

The CPU 1011 processes data according to a program stored in the MEM-P 1012. The CPU 1011 controls operations of the image reading unit 11, the image forming unit 12, the feeding unit 13, the transfer unit 14, the fixing unit 15, and the discharge unit 16. The MEM-P 1012 is a storage area of the control unit 10. The MEM-P 1012 includes a read only memory (ROM) 1012*a* and a random access memory (RAM) 1012*b*. The ROM 1012*a* serves as a memory for storing data and programs to be executed to perform each function of the control unit 10. The programs stored in the ROM 1012*a* may be files stored in a computer-readable recording medium such as a compact disc ROM (CD-ROM), a floppy disk (FD), a CD recordable (CD-R), and a digital versatile disc (DVD), the files being in an installable format or an executable format. The RAM 1012*b* serves as a memory for drawing. For example, the RAM 1012*b* is used when a program or data is loaded. The RAM 1012*b* is also used when print data is temporarily stored prior to printing.

The NB 1013 serves as a bridge for connecting the CPU 1011, the MEM-P 1012, the SB 1014, and the AGP bus 1015. The SB 1014 serves as a bridge for connecting the NB 1013, a peripheral component interconnect (PCI) device, and a peripheral device. The AGP bus 1015 serves as a bus interface for a graphic accelerator card designed to accelerate a graphical process. The ASIC 1016 includes a PCI target, an AGP master, and an arbiter (ARB) serving as the core of the ASIC 1016. Moreover, the ASIC 1016 includes a memory controller and a plurality of direct memory access controllers (DMACs). The memory controller controls the MEM-C 1017, and each of the DMACs rotates image data according to a hardware logic.

The ASIC 1016 is connected to a universal serial bus (USB) interface via a PCI bus 1000. The ASIC 1016 is connected to an Institute of Electrical and Electronics Engineers (IEEE) 1394 interface. The MEM-C 1017 is a local memory used as an image buffer for copying and a code buffer.

The HD 1018 serves as storage in which image data, font data, and forms are stored. The font data is used when printing is performed. The HDD 1019 controls reading or writing of data with respect to the HD 1018 according to the control by the CPU 1011. The network I/F 102 transmits and receives information to and from an external apparatus such as an information processing apparatus via a communication network.

The image reading unit 11 generates image data by optically reading an image on a sheet. Particularly, the image reading unit 11 irradiates the sheet with light and receives reflected light from the sheet using a reading sensor 112, thereby reading image data. The reading sensor is, for example, a charge coupled device (CCD) or a contact image sensor (CIS). The image data indicates an image to be formed on a sheet of recording media. Such image data is expressed using electrical color separation image signals indicating colors of red (R), green (G), and blue (B). As illustrated in FIG. 1, the image reading unit 11 includes a platen 111 and the reading sensor 112.

The platen 111 is a member on which a sheet having an image is placed. The reading sensor 112 reads image data of the image of the sheet placed on the platen 111.

The image forming unit 12 allows toner to adhere to a surface of an intermediate transfer belt 143 based on the image data read by the image reading unit 11 or the image data received by the network I/F 102. Thus, the image forming unit 12 forms an image (a toner image) on the intermediate transfer belt 143. The image forming unit 12 includes an image forming unit 120C, an image forming unit 120M, an image forming unit 120Y, an image forming unit 120K, and an image forming unit 120T. The image forming units 120C, 120M, 120Y, 120K, and 120T form toner images with developers having toners of cyan (C), magenta (M), yellow (Y), black (K), and clear (T), respectively. That is, in the present exemplary embodiment, the image forming unit 12 includes five image forming units 120C, 120M, 120Y, 120K, and 120T on a toner color basis. Hereinafter, the C, M, Y, and K toners are called a colored toner.

The image forming apparatus 1, as described below, forms an electrostatic latent image on each of the photosensitive drums 122, and develops each of the electrostatic latent images with a corresponding color of toner. Then, the image forming apparatus 1 transfers the toner images of respective colors to a recording medium such that the toner images are superimposed.

Among the image forming units 120C, 120M, 120Y and 120K with the respective colored toners and the image forming unit 120T with the clear toner, the image forming unit 120T is positioned at the extreme upstream side in transfer order of toner images. Each of the colored toners includes resin particles capable of carrying an electrical charge. The resin particles contain color material such as a pigment or dye. The clear toner represents a colorless transparent toner, and includes resin particles. When such a clear toner adheres to the colored toner adhering to a recording medium, the colored toner becomes visible.

Moreover, the clear toner includes resin particles that enable a recording medium to be visible when the clear toner adheres to the recording medium. For example, the clear toner is generated by adding silicon dioxide (SiO2) or titanium dioxide (TiO2) to low-molecular-weight polyester resin. The clear toner may include a color material as long as the recording medium or the colored toner adhering to the recording medium can be visible.

Hereinafter, any image forming unit among the image forming units 120C, the image forming units 120M, the image forming unit 120Y, the image forming unit 120K, and the image forming unit 120T is referred to as "an image forming unit 120".

The image forming unit 120C includes a toner bottle 121C serving as a toner replenishing member, a photoconductor drum (also called "a photoconductor") 122C, a charging unit 123C, an exposure unit 124C, a development unit 125C, a discharging unit 126C, and a cleaning unit 127C. The toner bottle 121 C stores a cyan toner. The cyan toner stored in the toner bottle 121C is supplied to the development unit 125C. When a conveyance screw inside the toner bottle 121C is driven, a predetermined amount of the cyan toner is supplied from the toner bottle 121C to the development unit 125C. The surface of the photoconductor drum 122C is uniformly charged by the charging unit 123C. On the uniformly charged surface of the photoconductor drum 122C serving as an image bearing member, an electrostatic latent image is formed by the exposure unit 124C based on image data received from the control unit 10.

The development unit 125C allows the toner to adhere to the electrostatic latent image formed on the surface of the photoconductor drum 122C, thereby forming a toner image on the photoconductor drum 122C. Moreover, the photoconductor drum 122C is disposed to contact the intermediate transfer belt 143 such that the photoconductor drum 122C rotates in the same direction as a movement direction of the intermediate transfer belt 143 at a point where the photoconductor drum 122C contacts the intermediate transfer belt 143.

The charging unit 123C uniformly charges a surface of the photoconductor drum 122C. The exposure unit 124C irradiates the uniformly charged surface of the photoconductor drum 122C with light based on a halftone dot area ratio of cyan, thereby forming an electrostatic latent image. The halftone dot area ratio is determined by the control unit 10. The development unit 125C develops the electrostatic latent image formed by the exposure unit 124C by allowing the cyan toner stored in the toner bottle 121C to adhere to the electrostatic latent image on the surface of the photoconductor drum 122C. Thus, the development unit 125C develops the electrostatic latent image into a toner image.

The discharging unit 126C discharges the surface of the photoconductor drum 122C after the toner image is transferred to the intermediate transfer belt 143. The cleaning unit 127C removes a residual transfer toner from the surface of the photoconductor drum 122C discharged by the discharging unit 126C.

The image forming unit 120M includes a toner bottle 121M, a photoconductor drum 122M, a charging unit 123M, an exposure unit 124M, a development unit 125M, a discharging unit 126M, and a cleaning unit 127M. The toner bottle 121M stores a magenta toner. Since the photoconductor drum 122M, the charging unit 123M, the exposure unit 124M, the development unit 125M, the discharging unit 126M, and the cleaning unit 127M function substantially similar to the photoconductor drum 122C, the charging unit 123C, the exposure unit 124C, the development unit 125C, the discharging unit 126C, and cleaning unit 127C, descriptions thereof are omitted. Similarly, descriptions of functions of similar elements for yellow, black, and clear toners are omitted.

The image forming unit 120Y includes a toner bottle 121 Y, a photoconductor drum 122Y, a charging unit 123Y, an exposure unit 124Y, a development unit 125Y, a discharging unit 126Y, and a cleaning unit 127Y. The toner bottle 121 Y stores a yellow toner.

The image forming unit 120K includes a toner bottle 121K, a photoconductor drum 122K, a charging unit 123K, an exposure unit 124K, a development unit 125K, a discharging unit 126K, and a cleaning unit 127K. The toner bottle 121K stores a black toner.

The image forming unit 120T includes a toner bottle 121T, a photoconductor drum 122T, a charging unit 123T, an exposure unit 124T, a development unit 125T, a discharging unit 126T, and a cleaning unit 127T. The toner bottle 12T stores a clear toner.

Hereinafter, any toner bottle among the toner bottle 121C, the toner bottle 121M, the toner bottle 121Y, the toner bottle 121K, and the toner bottle 121T is referred to as "a toner bottle 121".

Any photoconductor drum among the photoconductor drum 122C, the photoconductor drum 122M, the photoconductor drum 122Y, the photoconductor drum 122K, and the photoconductor drum 122T is referred to as "a photoconductor drum 122".

Any charging unit among the charging unit 123C, the charging unit 123M, the charging unit 123Y, the charging unit 123K, and the charging unit 123T is referred to as "a charging unit 123".

Any exposure unit among the exposure unit 124C, the exposure unit 124M, the exposure unit 124Y, the exposure unit 124K, and the exposure unit 124T is referred to as "an exposure unit 124".

Any development unit among the development unit 125C, the development unit 125M, the development unit 125Y, the development unit 125K, and the development unit 125T is referred to as "a development unit 125".

Any discharging unit among the discharging unit 126C, the discharging unit 126M, the discharging unit 126Y, the discharging unit 126K, and the discharging unit 126T is referred to as "a discharge unit 126".

Any cleaning unit among the cleaning unit 127C, the cleaning unit 127M, the cleaning unit 127Y, the cleaning unit 127K, and the cleaning unit 127T is referred to as "a cleaning unit 127".

The feeding unit 13 supplies a sheet to the transfer unit 14. The feeding unit 13 includes a sheet storage unit 131, a sheet feed roller 132, a sheet feed belt 133, and a pair of registration rollers 134. The sheet storage unit 131 stores sheets of a recording medium. The sheet feed roller 132 moves the sheet stored in the sheet storage unit 131 toward the sheet feed belt 133. Such a sheet feed roller 132 feeds the sheets one by one from the top of the stack, so that the fed sheet is placed on the sheet feed belt 133. The sheet feed belt 133 conveys the sheet fed by the sheet feed roller 132 to the transfer unit 14. The pair of registration rollers 134 times the conveyance of the sheet by the sheet feed belt 133 to coincide with the arrival of that portion of the intermediate transfer belt 143 bearing a toner image at the transfer unit 14.

The image formed on the photoconductor drum 122 by the image forming unit 12 is primarily transferred to the intermediate transfer belt 143. In a nip portion 140, the transfer unit 14 secondarily transfers the image transferred to the intermediate transfer belt 143 to the sheet. The transfer unit 14 includes a drive roller 141, a driven roller 142, the intermediate transfer belt 143, primary transfer rollers 144C, 144M, 144Y, 144K, and 144T, a secondary transfer roller 145, and a secondary transfer counter roller 146. The intermediate transfer belt 143 extends across the drive roller 141 and the driven roller 142. When the drive roller 141 rotates, the intermediate transfer belt 143 moves.

With the rotation of the drive roller 141, the intermediate transfer belt 143 moves while contacting the photoconductor drum 122. Such a movement of the intermediate transfer belt 143 enables the image formed on the photoconductor drum 122 to transfer to a surface of the intermediate transfer belt 143.

The primary transfer rollers 144C, 144M, 144Y, 144K, and 144T are disposed opposite the respective photoconductor drums 122C, 122M, 122Y, 122K, and 122T with the intermediate transfer belt 143 therebetween. The secondary transfer roller 145 rotates with the intermediate transfer belt 143 and a sheet nipped between the secondary transfer roller 145 and the secondary transfer counter roller 146.

The fixing unit 15 includes a conveyance belt 151, a fixing belt 152, a fixing roller 153, a fixing belt conveyance roller 154, a fixing counter roller 155, and a heat generating unit 156. The fixing unit 15 fixes the toner transferred to the sheet by the transfer unit 14. Fixing is an operation in which heat and pressure are simultaneously applied to the toner so that a resin component of the toner melts and adheres to the sheet. When the toner transferred to the sheet by the transfer unit 14 undergoes the fixing operation, the toner on the sheet becomes stable. The conveyance belt 151 conveys the sheet having the toner transferred by the transfer unit 14 toward the fixing roller 153 and the fixing counter roller 155.

The fixing belt 152 extends across the fixing roller 153 and the fixing belt conveyance roller 154. The fixing belt 152 moves with rotation of the fixing roller 153 and the fixing belt conveyance roller 154. The fixing roller 153 and the fixing counter roller 155 disposed opposite the fixing roller 153 nip the sheet conveyed by the conveyance belt 151 to heat and press the sheet. The fixing belt conveyance roller 154 and the fixing roller 153 are disposed so that the fixing belt 152 extends. The rotation of the fixing belt conveyance roller 154 moves the fixing belt 152. The fixing counter roller 155 is disposed opposite the fixing roller 153 to nip the sheet conveyed between the fixing counter roller 155 and the fixing roller 153. The heat generating unit 156 is disposed inside the fixing roller 153, and generates heat. The heat generating unit 156 heats the sheet through the fixing roller 153.

The discharge unit 16 discharges the sheet from the image forming apparatus 1, the sheet having the toner fixed by the fixing unit 15. The discharge unit 16 includes a discharge belt 161, a discharge roller 162, a discharge port 163, and a sheet storage unit 164. The discharge belt 161 conveys the sheet fixed by the fixing unit 15 toward the discharge port 163. The discharge roller 162 discharges the sheet conveyed by the discharge belt 161 from the discharge port 163 so that sheet is stored in the sheet storage unit 164. The sheet storage unit 164 stores the sheet discharged by the discharge roller 162.

The operation panel 17 includes a panel display unit 171 and an operation unit 172. The panel display unit 171 displays a setting value and a selection screen. The panel display unit 171 is, for example, a touch panel for receiving an input from a user. The operation unit 172 receives various inputs from the user. The operation unit 172 includes a numeric keypad that receives various conditions for image forming from the user, and a start key that receives a copy start instruction from the user.

Figure 3A:
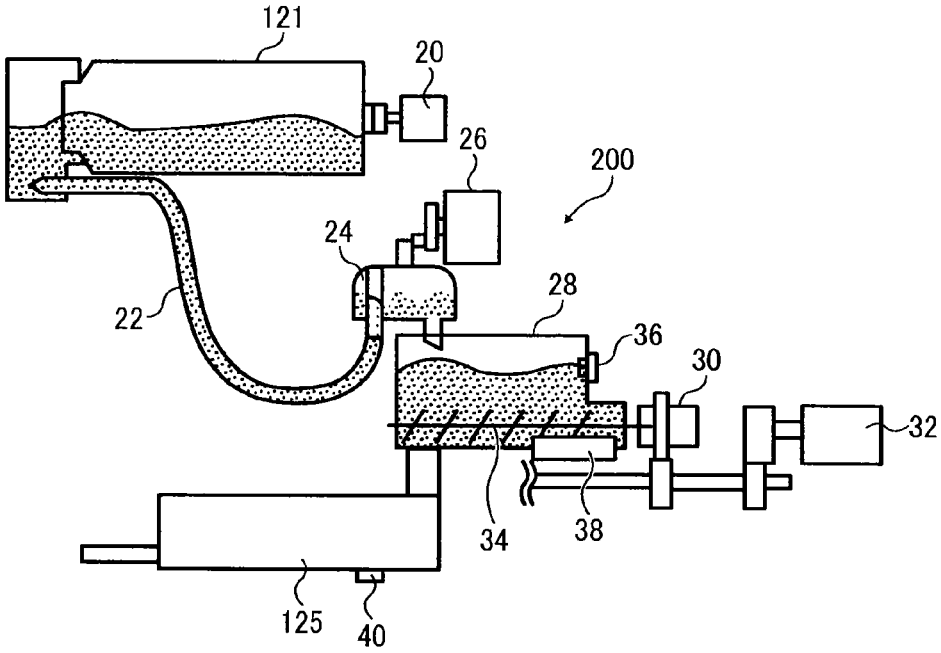
FIGS. 3A, 3B, and 3C are diagrams of a toner supply unit disposed in one of image forming units.

FIGS. 3A, 3B, and 3C, and FIG. 4 are diagrams illustrating a configuration of a toner supply unit 200, serving as a toner replenishing path, for replenishing toner from the toner bottle 121 to the development unit 125. As illustrated in FIG. 3A, the toner bottle 121 is rotated by a bottle drive motor 20. A diaphragm pump 24 is connected to the toner bottle 121 through a conveyance tube 22 serving as a replenishment tube. The diaphragm pump 24 sucks in the toner discharged by the rotation of the toner bottle 121. The diaphragm pump 24 is driven by a pump drive motor 26. The toner sucked in by the diaphragm pump 24 is discharged to a hopper 28. A replenishment screw 34 conveys the toner inside the hopper 28 to replenish the development unit 125 with the toner. The replenishment screw 34 is rotated by a replenishment motor 32 through a replenishment clutch 30.

The hopper 28 includes a toner sensor 36 and a toner end sensor 38. The toner sensor 36 detects an upper surface of the toner inside the hopper 28, whereas the toner end sensor 38 serving as a hopper toner detector detects that the hopper 28 is empty. The toner end sensor 38 is disposed at a bottom of the hopper 28. The development unit 125 includes a toner density sensor 40 serving as a toner density detector. The toner supply unit 200 disposed between the toner bottle 121 and the development unit 125 includes the conveyance tube 22, the diaphragm pump 24, and the hopper 28. Even when the toner bottle 121 and the development unit 125 are replaced to deal with a designated color, a last-used toner of a type different from that of the designated color remains in the toner supply unit 200. Consequently, if an image is formed as is, a color mixture of the remaining toner and a replacement toner may occur.

Figure 4:
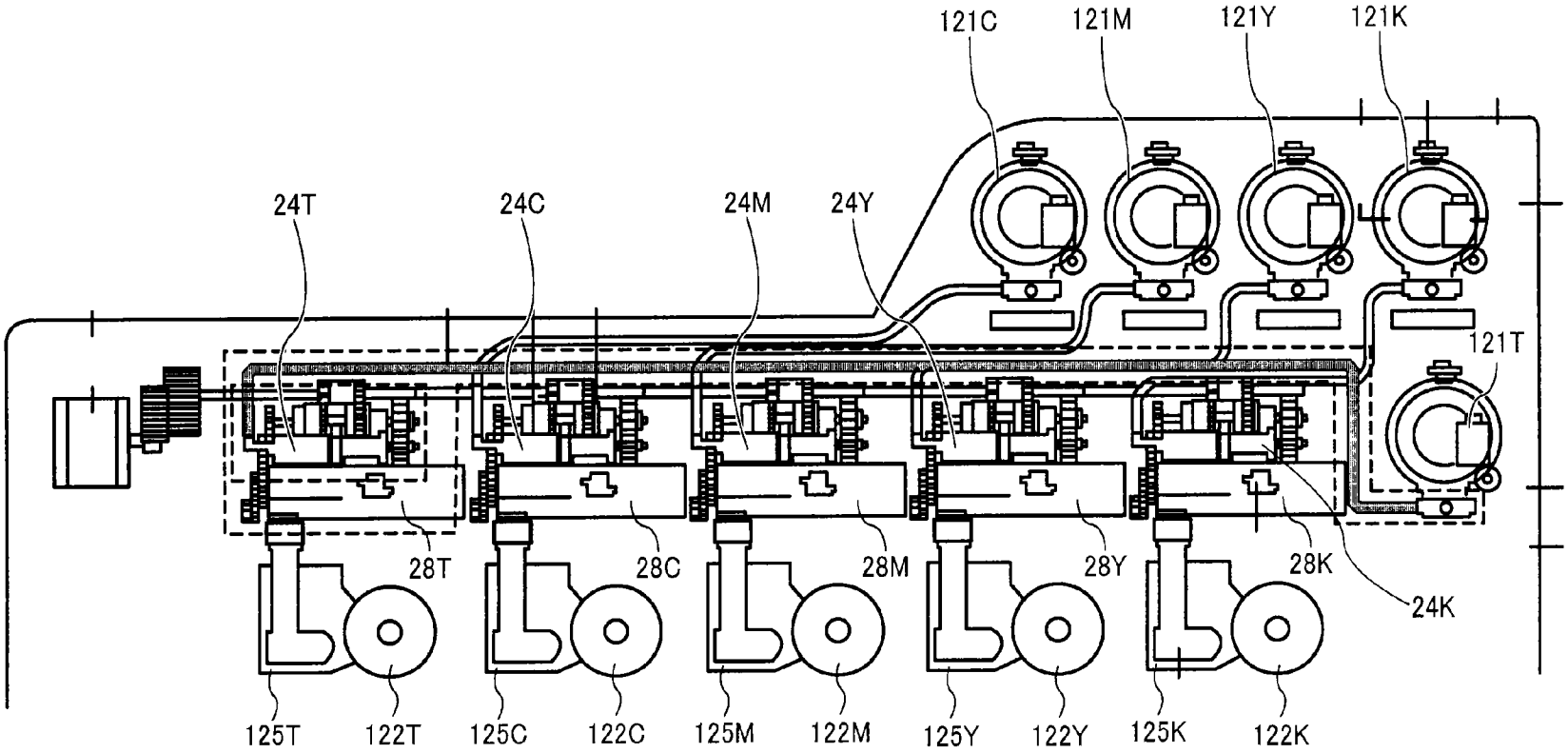
FIG. 4 is a diagram of all of the image forming units.

Each of the toner bottle 121 and the development unit 125 is replaceable with respect to the body of the image forming apparatus 1. FIG. 4 is a diagram illustrating an example of a compact arrangement of the image forming units 120. In the arrangement illustrated in FIG. 4, the toner bottle 121T for a special toner is arranged in a position slightly different from that illustrated in FIG. 1. Even in such an arrangement, a remaining toner of a different type remains in a toner supply unit.

Figure 5:
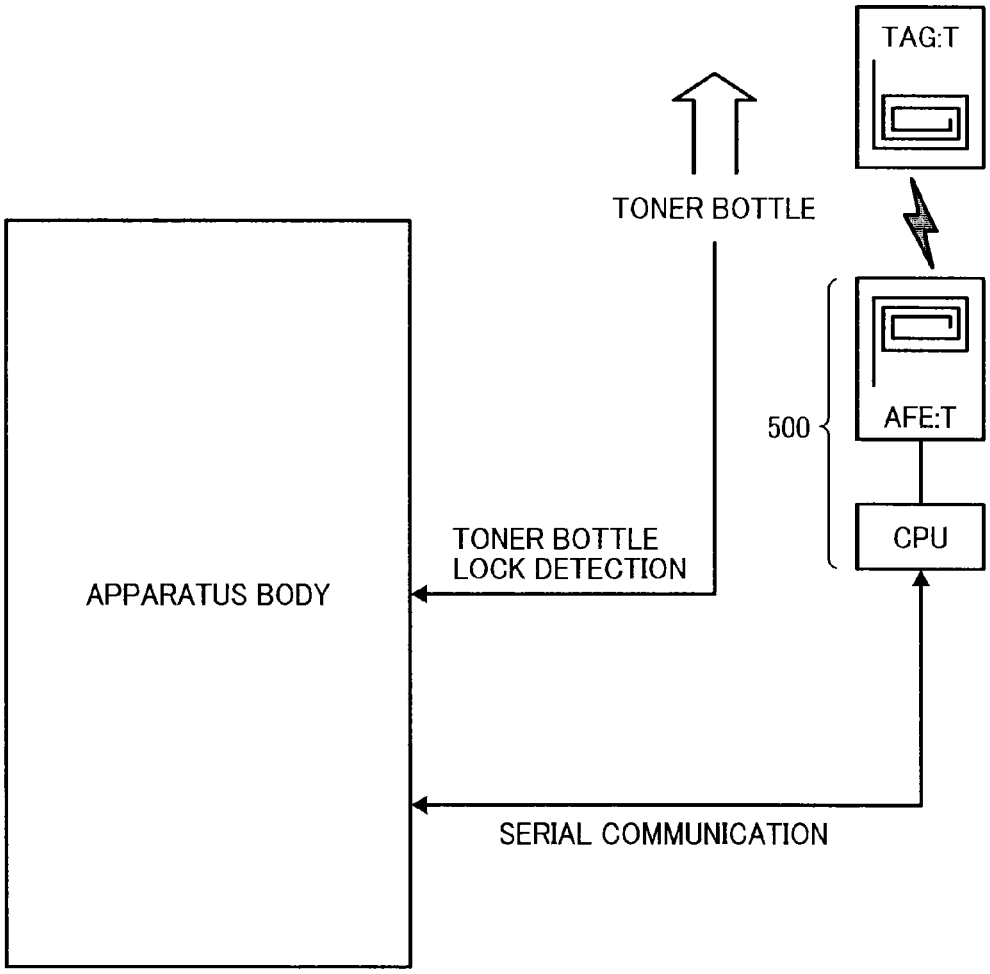
FIG. 5 is a schematic diagram of a configuration for reading toner type information attached to a toner bottle.

The toner bottle 121 is equipped with an identification (ID) chip (a nonvolatile memory). Toner type information is read from and written to the ID chip. Meanwhile, the image forming apparatus 1 includes a toner type information detector 500 for acquiring the toner type information by accessing the ID chip. Such a configuration is described with reference to FIG. 5. A radio frequency identification (RFID) chip serving as the ID chip attached to the toner bottle 121 and the periphery thereof are comprehensively described. The image forming apparatus 1 includes a substrate on which an antenna and a modulation and demodulation integrated circuit (IC) (hereinafter referred to as an analog font end (AFE)) having one channel are mounted, and another substrate on which one CPU is mounted. Such a structure enables the RF serving as a toner bottle ID tag to be accessed, and thus information can be read from and written to the memory of the RF tag attached to a toner bottle of T color. This structure also functions as the toner type information detector 500. The image forming apparatus 1 (apparatus body) transmits and receives command data. The transmission and reception of the command data is described in detail below.

1: The command data is transmitted and received (serial 9600 bps) between the apparatus body and the CPU.

2: The CPU is reset by port reset.

3: The CPU analyses the command data by internal process.

4: The command/data is transmitted and received (serial 106 kbps (13.56 MHz) between the CPU and AFE (RFID_RW).

5: The command/data undergoes amplitude shift keying (ASK) modulation in the AFE (RFID_RW), and the resultant command/data is read/written to the RF tag (a carrier wave of 13.56 MHz, a bit rate of 26 kbps).

The image forming apparatus 1 includes a toner bottle lock sensor for detecting that the toner bottle 121 is locked. The image forming apparatus 1 determines, based on a signal from the toner bottle lock detection sensor, whether the toner bottle 121 is attached.

Figure 6A:
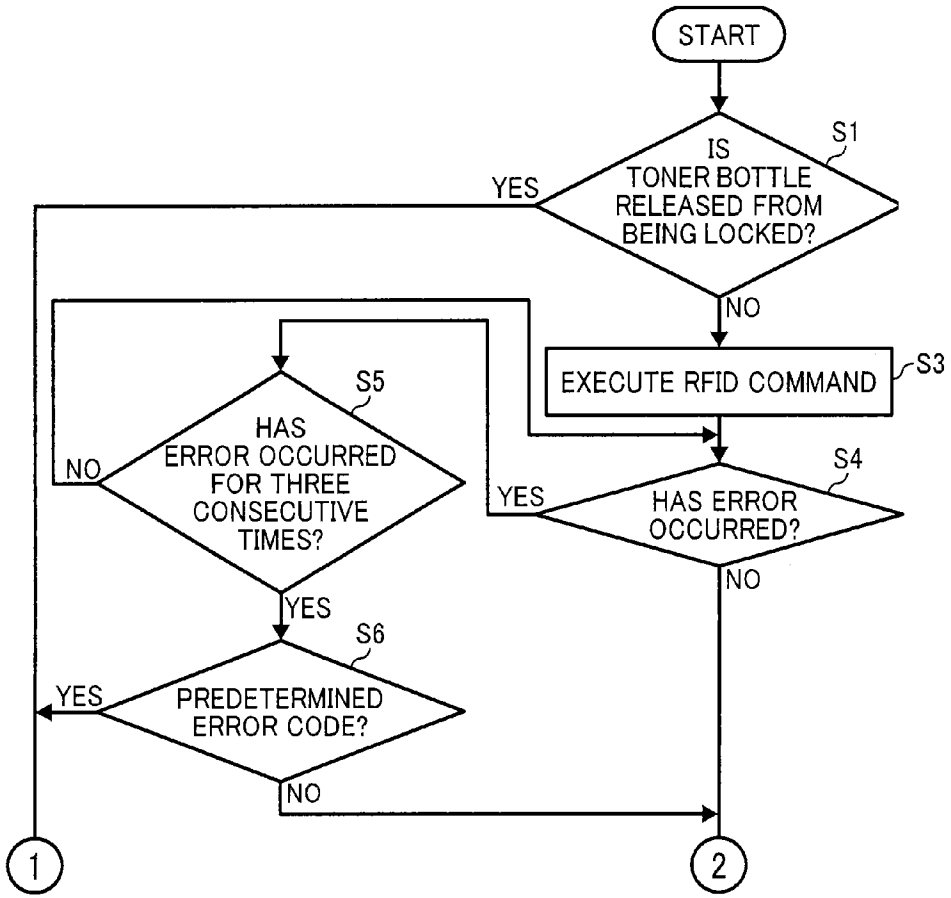
FIGS. 6A and 6B are flowcharts of a procedure performed when an identification (ID) chip attached to a toner bottle is activated.
Figure 6B:
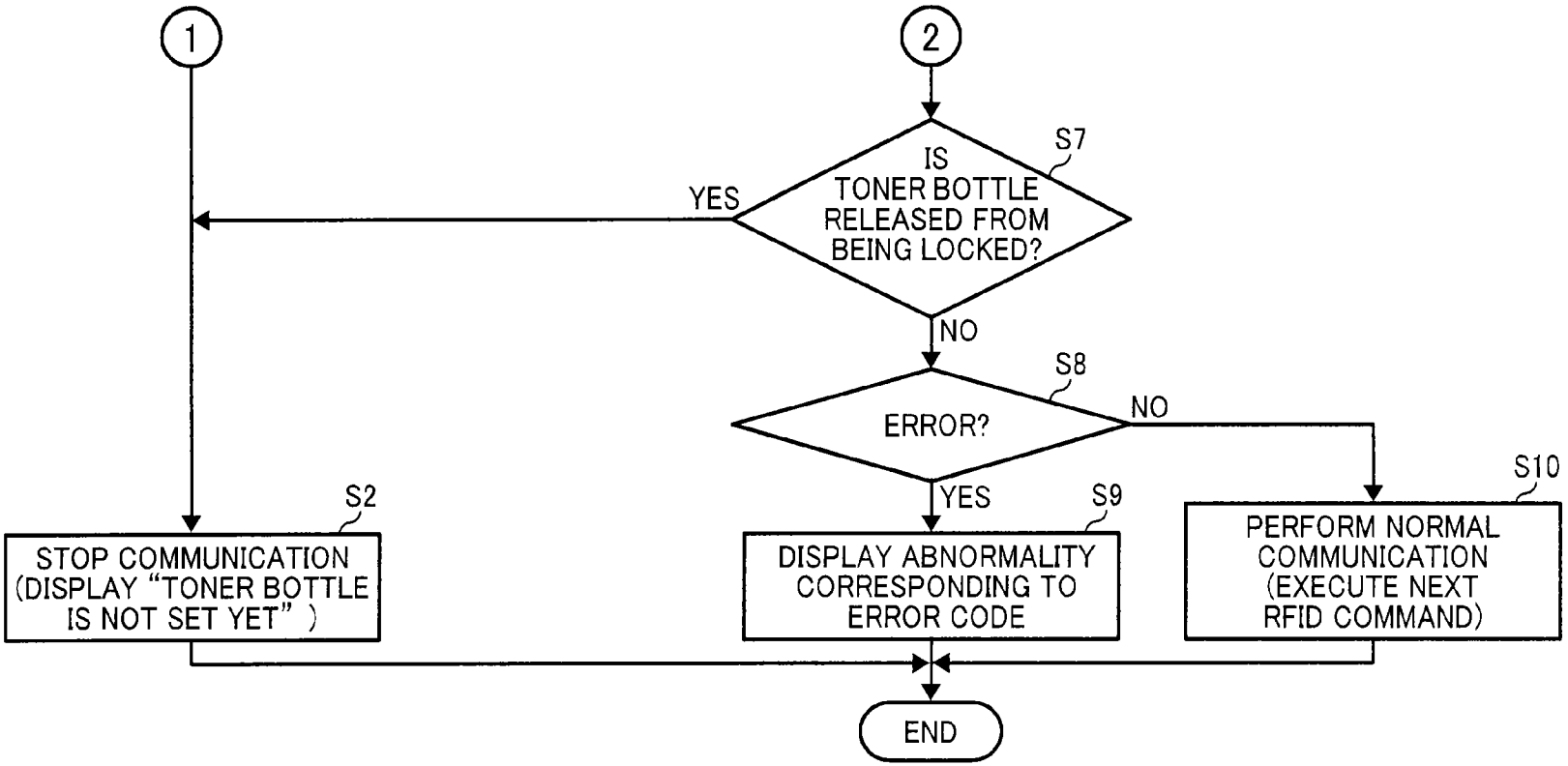

FIGS. 6A and 6B are flowcharts of a procedure performed when the RFID chip serving as the ID chip attached to the toner bottle 121 is activated. The CPU (RFID_RW) is reset by the activation flow described below. In the RFID communication, immediately before and after an RFID command is executed, the image forming apparatus 1 acquires a determination result indicating whether the toner bottle 121 is "locked" or "released from being locked". Immediately after execution of the RFID command, the image forming apparatus 1 acquires the determination result indicating "locked" or "released from being locked" regardless of a determination result of the presence or absence of an RFID response error. Accordingly, the image forming apparatus 1 determines whether the toner bottle 121 is normal, is malfunctioning, or is not set yet, based on the determination result indicating the presence or absence of the error and the determination result indicating whether the toner bottle 121 is "locked" or "released from being locked".

More specifically, in step S1, the image forming apparatus 1 determines, based on a signal from the toner bottle lock detection sensor disposed thereto, whether the toner bottle 121 is released from being locked. If YES in step S1, the process proceeds to step S2 in which the image forming apparatus 1 stops the communication. In such a case, the image forming apparatus 1 displays a message, for example, "the toner bottle 121 is not set yet" on the panel display unit 171. If the toner bottle 121 is not released from being locked (NO in step S1), the process proceeds to step S3 in which the image forming apparatus 1 executes an RFID command to read a toner type. In step S4, the image forming apparatus 1 determines whether an error has occurred. If YES in step S4, the process proceeds to step S5. In step S5, the image forming apparatus 1 determines whether the error has occurred consecutively for the predetermined number of times (herein, three times).

In the exemplary embodiment, the error includes: 1) a case where the ID chip cannot be accessed due to damage to or failure of the ID chip; 2) a case where the ID chip is not an accessible official product; 3) a case where the ID chip is not attached; and 4) a case where the toner type information detector serving as an ID chip reading unit disposed in the image forming apparatus 1 has a problem.

If the error occurs three times in succession (YES in step S5), the process proceeds to step S6 in which the image forming apparatus 1 determines whether the error has a predetermined error code. If the error has the predetermined error code (YES in step S6), the process proceeds to step S2 in which the image forming apparatus 1 stops the communication and displays a message that "the toner bottle 121 is not set yet". Herein, the predetermined error code indicates a case where the image forming apparatus 1 cannot acquire the ID tag of the toner bottle 121 due to a problem of the ID chip, for example, any of the errors (1) through (3) described above. If no error has occurred (NO in step S4), that is, the image forming apparatus 1 has acquired the toner type information, the process proceeds to step S7. In step S7, the image forming apparatus 1 determines again whether the toner bottle 121 is released from being locked. If the toner bottle 121 is released (YES in step S7), the process proceeds to step S2 in which the image forming apparatus 1 stops the communication and displays the message that "the toner bottle 121 is not set yet". Herein, the detection of the release of the toner bottle 121 indicates that the user has removed the toner bottle 121 after the RFID command is executed.

If the toner bottle 121 is not released from being locked (NO in step S7), the process proceeds to step S8 in which the image forming apparatus 1 determines whether there is an error (whether an error has occurred for three consecutive times in step S5). If YES in step S8, the process proceeds to step S9 in which the image forming apparatus 1 displays a malfunction corresponding to the error code. The error in step S8 differs from that in step S4, and is, for example, the error (4) described above. When the error occurs in step S8, a service representative needs to be called. Thus, in step S9, the image forming apparatus 1 displays the malfunction instead of the message that "the toner bottle 121 is not set yet". If NO in step S8, the process proceeds to step S10 in which the image forming apparatus 1 determines that communication is normal, and executes a next RFID command.

Figure 7A:
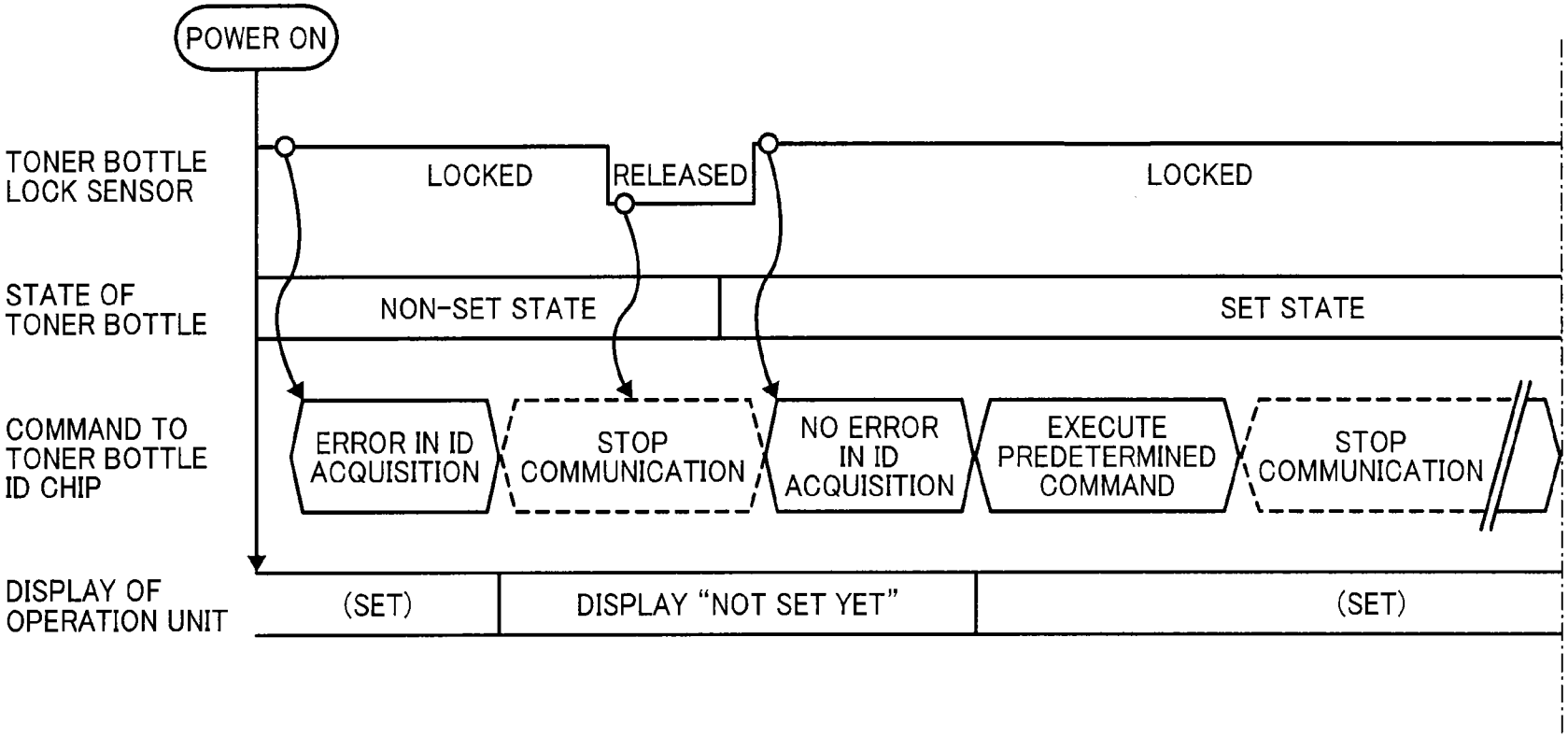
FIGS. 7A and 7B are timing charts of shifts in states of the toner bottle.
Figure 7B:
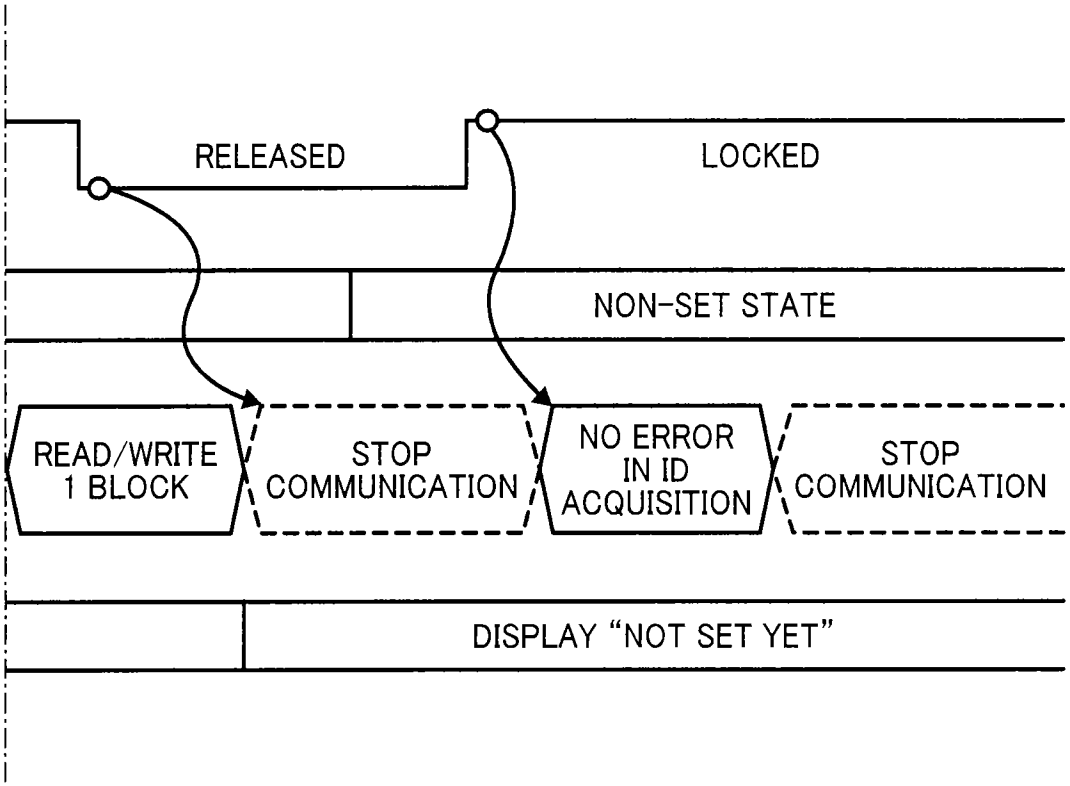

FIG. 7 illustrates shifts in states of the toner bottle 121. In FIG. 7, the image forming apparatus 1 is turned on when the toner bottle 121 is not set. The state of the toner bottle 121 is shifted from a non-set state to a set state, and then shifted to a non-set state again as illustrated in FIG. 7. The development unit 125 has an ID chip as similar to the toner bottle 121. With the ID chip, a toner type of the development unit 125 set in the image forming apparatus 1 can be detected. Moreover, the set state and the non-set state of the development unit 125 can be detected by a method similar to the above.

Next, a toner supply unit cleaning mode is described.

Figure 8:
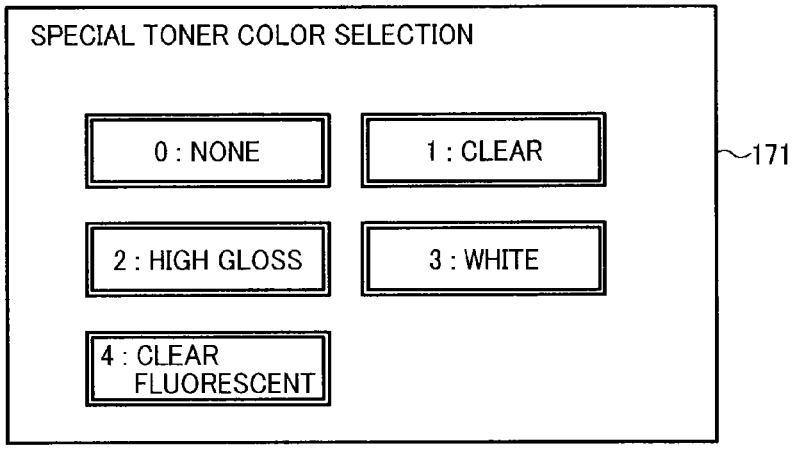
FIG. 8 is a diagram of a special toner color selection keys on an operation panel.

When the image forming apparatus 1 is not forming an image, a user designates a toner type to be replaced using the panel display unit 171 or a digital front end. As illustrated in FIG. 8, the panel display unit 171 includes special color toner selection keys. The user can select a desired color using the special color selection key. According to the designated toner type, toner type information is recorded in the image forming apparatus 1. Subsequently, the panel display unit 171 or the digital front end displays guidance so that the user removes the toner bottle 121 having the last-used color.

Figure 3B:
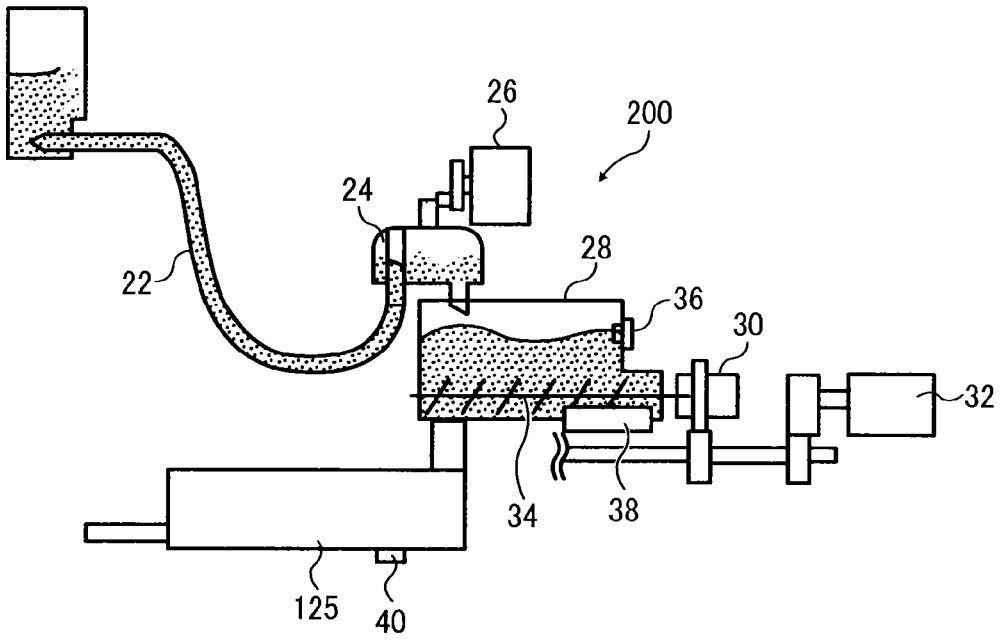

FIG. 3B illustrates a state in which the toner bottle 121 is removed. In FIG. 3B, the toner of the last-used color remains in the toner supply unit 200.

Figure 3C:
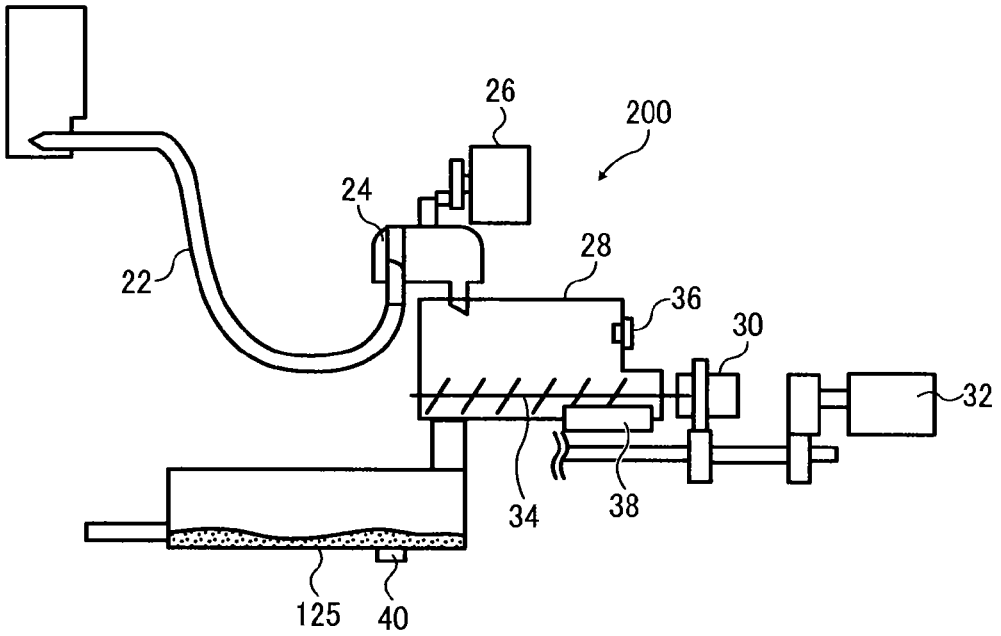

After confirming that the toner bottle 121 is removed, the image forming apparatus 1 drives only the diaphragm pump 24, the hopper 28, and the development unit 125 to move all the toner inside the conveyance tube 22, the diaphragm pump 24, and the hopper 28 to the development unit 125. FIG. 3C illustrates a state in which all the toner inside the toner supply unit 200 is collected in the development unit 125. Accordingly, toner density inside the developing unit 125 increases. In a case where the toner density exceeds an upper limit, the image forming apparatus 1 executes a toner discharge mode.

In the toner discharge mode, the image forming apparatus 1 controls operations, thereby forming an image on the photoconductor drum 122 without feeding a sheet and collecting toner without transferring the image. For example, the image forming apparatus 1 forms an image having an image area ratio of 50% in an amount of five A3 size sheets. A transfer current for each of a primary transfer and a secondary transfer is set to zero μA, and the discharged toner is collected when the photoconductor drum 122 and the intermediate transfer belt 143 are cleaned. Such discharge of the toner can prevent toner scattering and an excess volume of the developer caused by an increase in the toner density inside the development unit 125.

Figure 9:
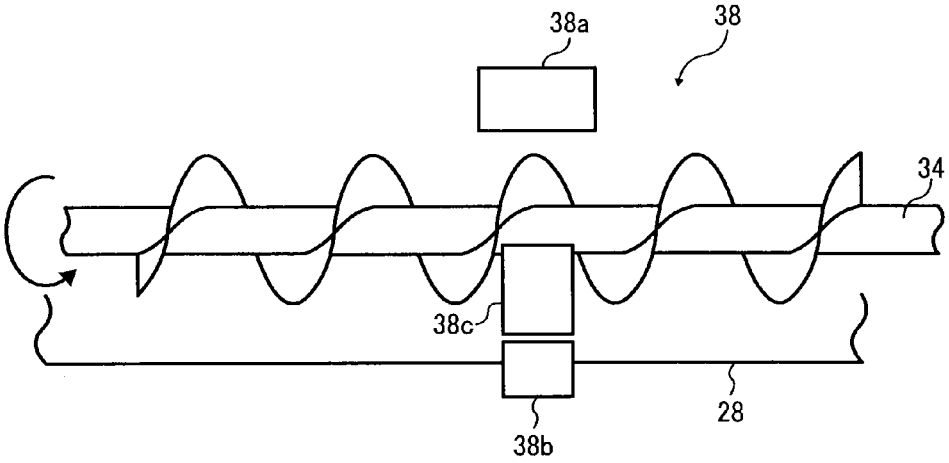
FIG. 9 is a schematic diagram of a toner end sensor detecting an empty hopper having no toner.

When the hopper 28 is empty, the image forming apparatus 1 stops driving the hopper 28. The toner end sensor 38 disposed at a bottom of the hopper 28 detects that the hopper 28 is empty when there is no toner inside the hopper 28. As illustrated in FIG. 9, the toner end sensor 38 includes a light emitting unit 38*a*, a light emitting unit 38*b*, and a cleaning member 38*c* for cleaning the light emitting unit 38*b*. The cleaning member 38*c* is made of a soft material and disposed on a shaft of the replenishment screw 34 for conveying the toner. The cleaning member 38*c* scrapes the toner off the surface of the light emitting unit 38*b* with each rotation cycle of the replenishment screw 34.

When the conveyance path of the hopper 28 is filled with toner, light is blocked by the toner. Accordingly, the toner end sensor 38 can detect a remaining amount of the toner from a light receiving amount. Alternatively, the toner density sensor 40 attached to the development unit 125 may detect an empty state in the hopper 28. In such a case, the toner density sensor 40 detects changes in toner density. When the toner density sensor 40 detects that the toner density stops increasing, it is determined that the hopper 28 is empty.

Figure 10:
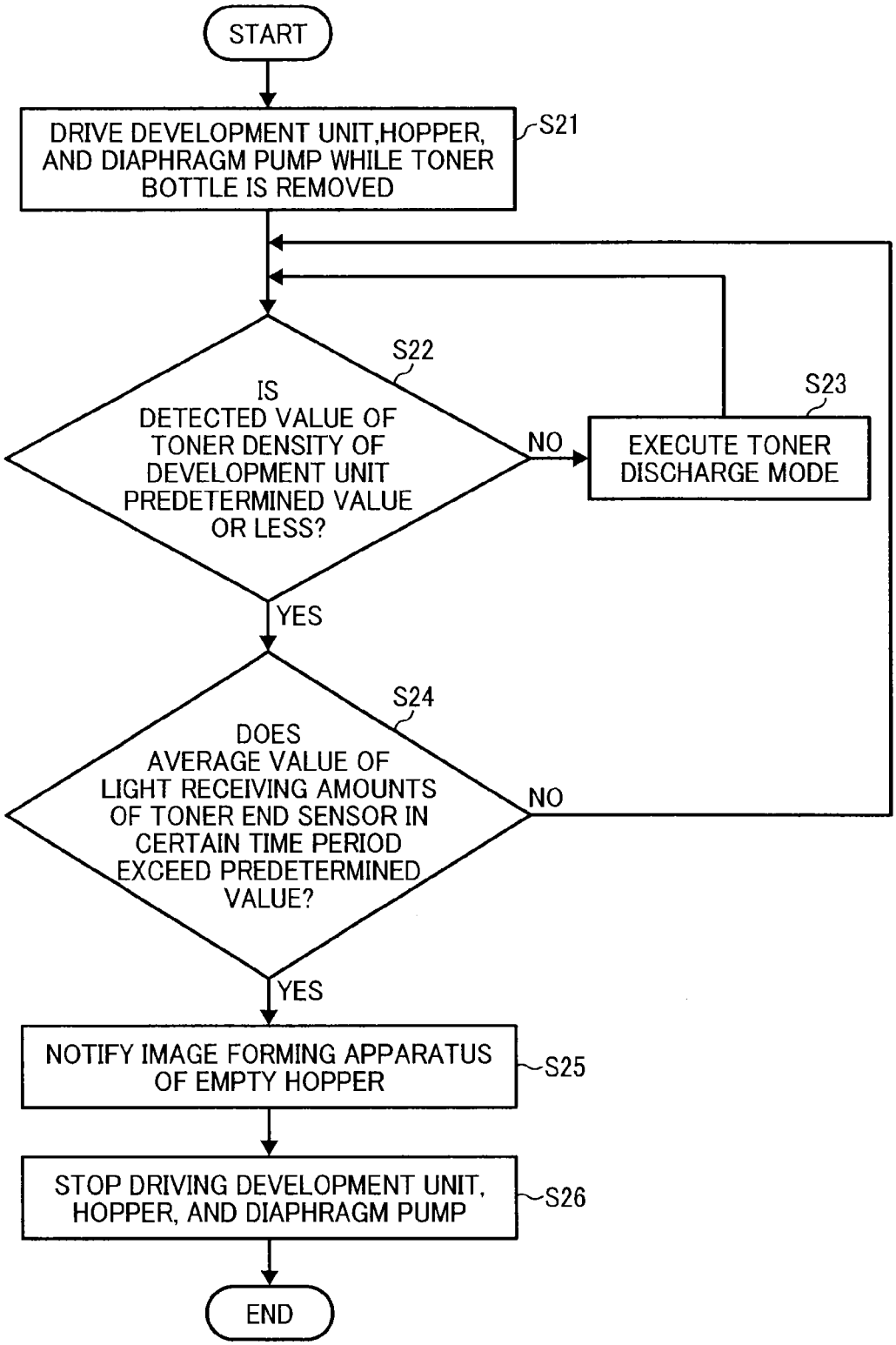
FIG. 10 is a flowchart of operations performed in a toner supply unit cleaning mode in a case where the toner end sensor is used.

FIG. 10 is a flowchart illustrating a procedure for operating the toner supply unit cleaning mode in a case where the toner end sensor 38 is used to detect that the hopper 28 is empty. In step S21, the image forming apparatus 1 drives the diaphragm pump 24, the hopper 28, and the development unit 125 in a state that a last-used toner bottle 121 is being removed from the image forming apparatus 1.

In step S22, the image forming apparatus 1 determines whether a detected value of the toner density inside the development unit 125 is a predetermined value or less. If NO in step S22, the process proceeds to step S23, whereas if YES in step S22, the process proceeds to step S24. In step S23, the image forming apparatus 1 executes the toner discharge mode. In step S24, the image forming apparatus 1 determines whether an average value of light receiving amounts detected by the toner end sensor 38 within a certain time period exceeds a predetermined value. If YES in step S24, the process proceeds to step S25, whereas if NO in step S24, the process returns to step S22. In step S25, the toner end sensor 38 informs the image forming apparatus 1 that the hopper 28 is empty. In step S26, after confirming that there is no toner in the hopper 28, the image forming apparatus 1 stops driving the diaphragm pump 24, the hopper 28, and the development unit 125. Accordingly, the cleaning of the toner supply unit 200 is completed. Since the image forming apparatus 1 uses the toner end sensor 38 to detect that the hopper 28 is empty, the empty hopper can be detected with high accuracy.

Figure 11:
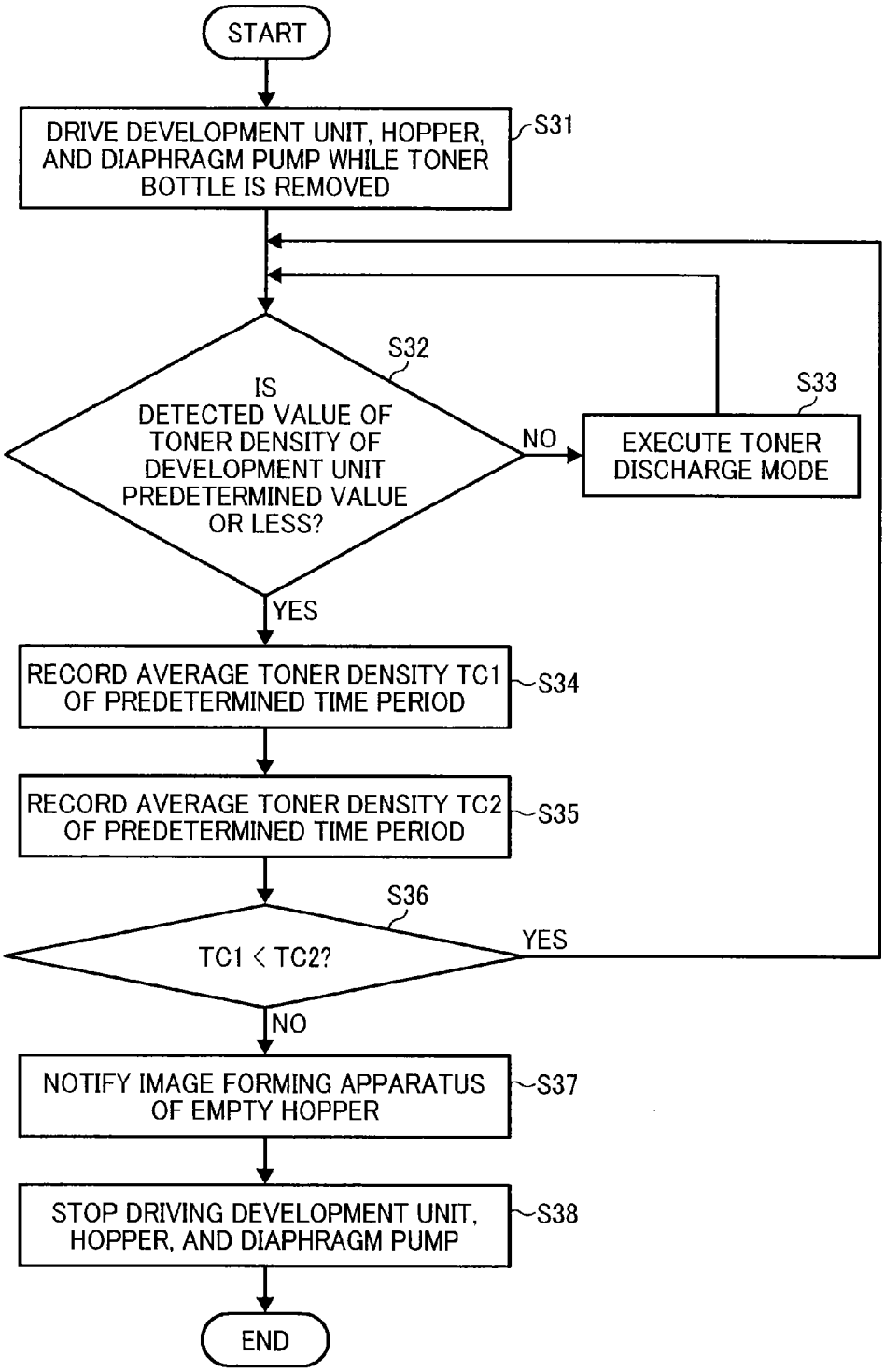
FIG. 11 is a flowchart of operations performed in the toner supply unit cleaning mode in a case where a detection sensor of a development unit is used.
Figure 12:
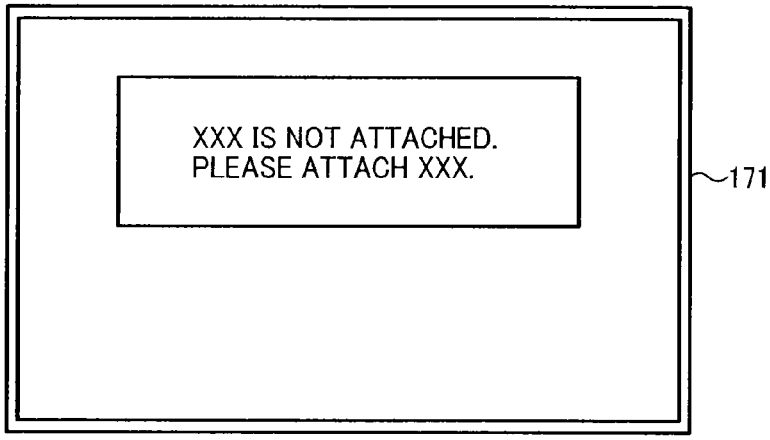
FIG. 12 is a schematic view of a message displayed on the operation panel when the toner bottle is not set.

FIG. 11 is a flowchart illustrating a procedure for operating the toner supply unit cleaning mode in a case where the toner density sensor 40 is used to detect that the hopper 28 is empty. Since processes in steps S31 through S33 of the flowchart illustrated in FIG. 11 are substantially the same as those in steps S21 through S23 of the flowchart illustrated in FIG. 10, descriptions thereof are omitted.

If the toner density is the predetermined value or less (YES in step S32), the process proceeds to step S34. In step S34, the image forming apparatus 1 records an average toner density TC1 that is an average value of toner densities within a certain time period. Subsequently, in step S35, the image forming apparatus 1 records an average toner density TC2 within the certain time period in T seconds. In step S36, the image forming apparatus 1 determines whether the average toner density TC2 exceeds the average toner density TC1. If the average toner density TC2 exceeds the average toner density TC1 (YES in step S36), the process returns to step S32. On the other hand, if the average toner density TC2 does not exceed the average toner density TC1 (NO in step S36), the process proceeds to step S37. In step S37, the toner density sensor 40 informs the image forming apparatus 1 that the hopper 28 is empty. In step S38, after confirming that there is no toner in the hopper 28, the image forming apparatus 1 stops driving the diaphragm pump 24, the hopper 28, and the development unit 125. Accordingly, the cleaning of the toner supply unit 200 is completed. Since the toner density sensor 40 can detect that the hopper 28 is empty, an empty detection sensor is not necessary, thereby reducing costs of the image forming apparatus 1.

Then, the image forming apparatus 1 displays guidance on the panel display unit 171 or the digital front end. With the displayed guidance, the user can remove the development unit 125 having the last-used color, and set another toner bottle 121 and another replacement development unit 125 of a toner type that is intended to be replaced. The guidance may be displayed in the form of text or audio. In a case where the replacement toner bottle 121 and the replacement development unit 125 are not set, a message as illustrated in 12 is displayed to prompt the user to set at least one of the replacement toner bottle 121 and the replacement development unit 125. When confirming that the replacement toner bottle 121 and the replacement development unit 125 are set, the image forming apparatus 1 determines whether toner type information of the toner bottle 121 and the development unit 125 matches that in the image forming apparatus 1.

Figure 15:
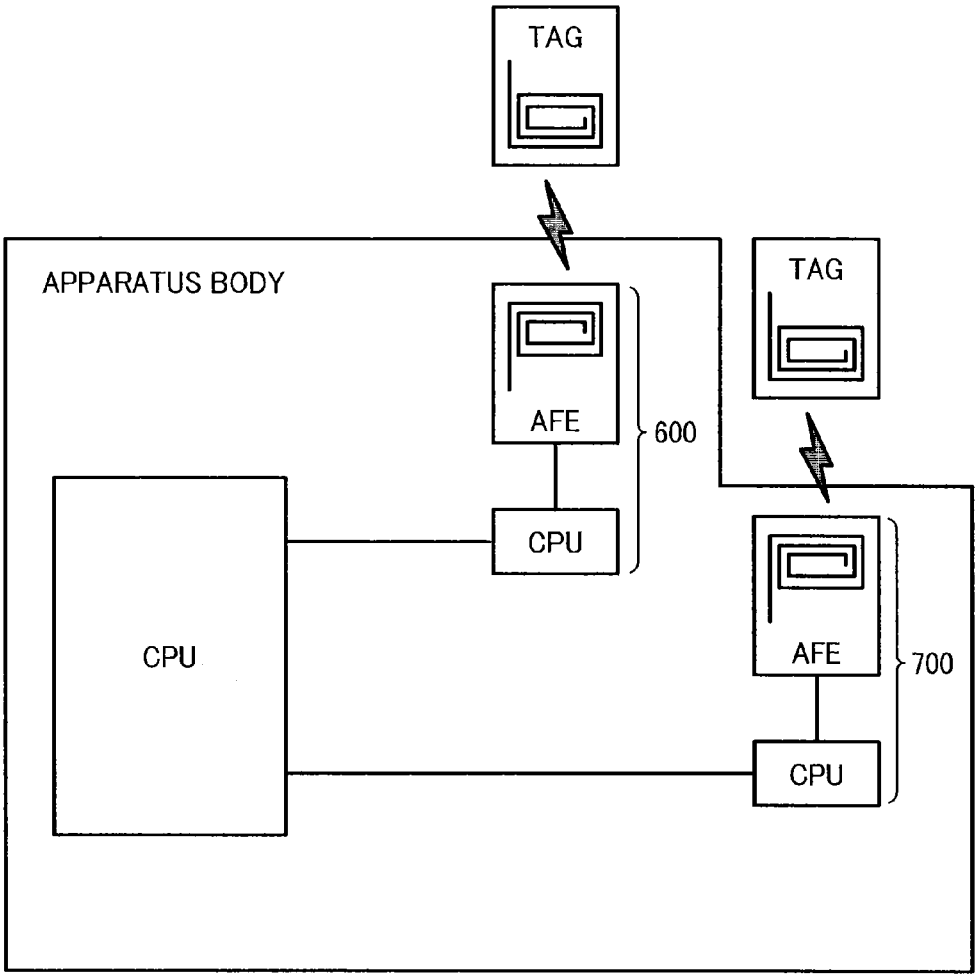
FIG. 15 is a schematic diagram of a configuration for reading toner type information by using a toner type information detector reading an ID tag from a toner bottle and another toner type information detector reading an ID tag from a development unit.

As illustrated in FIG. 15, the image forming apparatus 1may include a toner type information detector 600 for detecting toner type information from an ID tag of the toner bottle 121, and a toner type information detector 700 for detecting toner type information from an ID tag of the development unit 125. The toner type information detectors 600 and 700 serve as a first toner type information detector and a second toner type detector, respectively. In such a configuration, the apparatus body includes a CPU for controlling reading operations. Since a configuration of each reading unit is substantially the same as that of the reading unit illustrated in FIG. 5, a description thereof is omitted.

Figure 13:
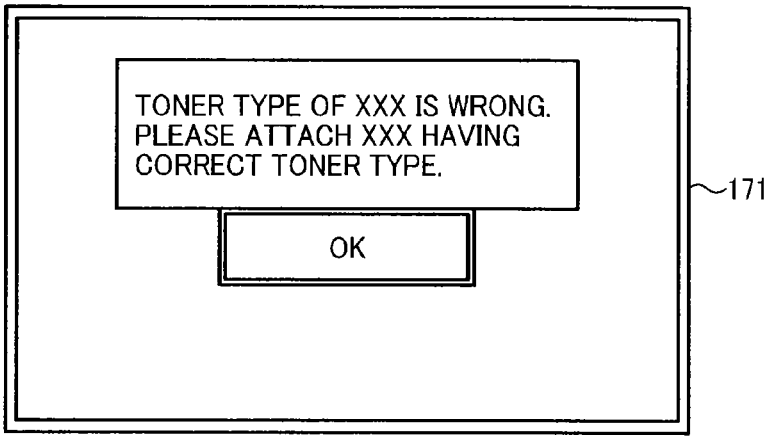
FIG. 13 is a schematic view of a message displayed on the operation panel when a toner type of a set bottle is not correct.
Figure 14:
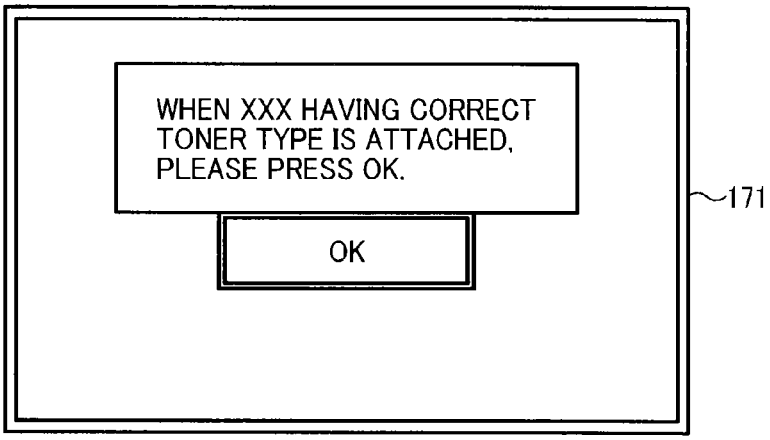
FIG. 14 is a schematic view of a message displayed on the operation panel when a toner bottle having a correct toner type is set.

If the toner type information of the toner bottle 121 and the development unit 125 does not match that in the image forming apparatus 1, a message as illustrated in FIG. 13 is displayed on the panel display unit 171 or the digital front end. The message as illustrated in FIG. 13 notifies the user that the toner type information of at least one of the toner bottle 121 and the development unit 125 does not match that in the image forming apparatus 1. In such a state, the image forming apparatus 1 cannot execute an image forming operation. When the toner bottle 121 and the development unit 125 are correctly set, a message as illustrated in FIG. 14 is displayed, and the user presses an OK button. If the toner type information of the toner bottle 121 and the development unit 125 matches the toner type information in the image forming apparatus 1, the image forming apparatus 1 performs a start-up operation and becomes ready for image forming operation.

Accordingly, when the toner is replaced, the execution of the toner supply unit cleaning mode can not only prevent a color mixture of the last-used toner and the replacement toner, but also prevent generation of an irregular image. Moreover, the execution of the toner supply unit cleaning mode does not require removal of the toner supply unit 200, thereby eliminating concerns including damage to the image forming unit 12.

Therefore, the image forming apparatus 1 employing such a toner replenishing method allows replacement of toners including the CMYK process toners and the special color toner by using the toner replenishing member without a problem such as a color mixture.

In the exemplary embodiment, the toner supply unit 200 between the toner bottle 121 and the development unit 125 which are detachable from the image forming apparatus 1 is cleaned. Similarly, the exemplary embodiment may be applied to a configuration in which a toner supply unit between a toner bottle 121 and an image forming unit 12 is cleaned. In the exemplary embodiment, moreover, the image forming apparatus 1 includes five image forming units. However, the exemplary embodiment may be applied to a general image forming apparatus having four image forming units. In such a case, toner is replaced as in the above exemplary embodiment.

In the exemplary embodiment, moreover, the hoppers 28 in the respective image forming units 12 have the same size. However, a hopper in an image forming unit disposed on an extreme upstream or downstream side may have smaller capacity than the other hoppers, since a toner type of the hopper disposed on the extreme upstream or downstream side is more likely to be replaced. Alternatively, the hopper may not be disposed at all. Accordingly, a toner density of the development unit 125 does not exceed a predetermined value. Therefore, there is an advantage that the image forming apparatus 1 can execute the toner supply unit cleaning mode without discharging the toner.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. An image forming apparatus, comprising:

a plurality of image bearers;

replaceable developing devices each provided for a corresponding one of the plurality of image bearers to render electrostatic latent images formed on respective image bearers visible as toner images based on image data;

replaceable toner replenishers each provided for a corresponding one of the replaceable developing devices to replenish toner to respective replaceable developing devices;

toner suppliers arranged between respective toner replenishers and the respective replaceable developing devices; and a controller configured to cause the image forming apparatus to perform a cleaning mode by conveying a last-used toner inside a toner supplier arranged between a corresponding replaceable toner replenisher and a corresponding replaceable developing device to the corresponding replaceable developing device to empty the toner supplier, when replacements of the corresponding replaceable developing device and the corresponding replaceable toner replenisher are designated to use a toner of a type different from the last-used toner.

2. The image forming apparatus according to claim 1, wherein the toner supplier includes a replenishment tube, a pump, and a hopper, the hopper includes a hopper toner detector to detect that there is no toner inside the hopper, and when the cleaning mode is performed, the corresponding replaceable developing device and the pump and the hopper corresponding to the corresponding replaceable developing are driven until there is no toner left inside the hopper.

3. The image forming apparatus according to claim 2, further comprising a toner density detector to detect a toner density of the corresponding replaceable developing device, wherein the controller determines that the hopper is empty when the toner density detected by the toner density detector does not increase within a predetermined time period.

4. The image forming apparatus according to claim 2, wherein the hopper toner detector is provided on a bottom side of the hopper to detect presence or absence of the last-used toner inside the hopper.

5. The image forming apparatus according to 1, wherein when a toner density of the corresponding replaceable developing device exceeds an upper limit, the controller causes the image forming apparatus to perform a toner discharge mode to collect the last-used toner without transferring the last-used toner to a recording medium by an image forming operation.

6. The image forming apparatus according to 1, further comprising a toner type information detector to acquire toner type information, recorded in each of the replaceable developing devices and the replaceable toner replenishers, indicating a type of toner stored in each of the replaceable developing devices and the replaceable toner replenishers, wherein an image forming operation is not performed when a combination of designated toner types to form an image does not match toner types of a replaced developing device and a replaced toner replenisher.

7. An image forming apparatus comprising:

an image bearer to bear a latent image;

a developing device to develop the latent image;

a toner container to store toner;

a temporary reservoir to store the toner received from the toner container;

a first conveyer to transport the toner from the toner container to the temporary reservoir;

a second conveyer to transport the toner from the temporary reservoir to the developing device; and a controller configured to perform a cleaning mode before replacements of the developing device and the toner container are designated to use a different toner, wherein in the cleaning mode, the toner inside the temporary reservoir, the first conveyer, and the second conveyer is conveyed to the developing device.

8. The image forming apparatus according to claim 7, wherein the cleaning mode is performed after the toner container is detached from the image forming apparatus.

9. The image forming apparatus according to claim 7, further comprising:

a pump disposed between the first conveyer and the temporary reservoir, wherein the first conveyer includes a tube.

10. The image forming apparatus according to claim 9, wherein the temporary reservoir includes a toner detector to detect the toner inside the temporary reservoir, and in the cleaning mode, the pump is driven until the toner detector detects no toner left inside the temporary reservoir.

11. The image forming apparatus according to claim 10, wherein the toner detector is provided on a bottom side of the temporary reservoir to detect presence or absence of the toner inside the temporary reservoir.

12. The image forming apparatus according to claim 9, wherein the temporary reservoir includes a toner detector to detect an upper surface of the toner inside the temporary reservoir.

13. The image forming apparatus according to claim 7, further comprising:

a toner density detector to detect a toner density in the developing device, wherein the controller determines that the temporary reservoir is empty when the toner density does not increase within a predetermined time period.

14. The image forming apparatus according to claim 7, wherein the controller causes the image forming apparatus to perform a toner discharge mode when a toner density of the developing device exceeds an upper limit, and in the toner discharge mode, the controller causes the image forming apparatus to discharge the toner inside the developing device to the image bearer and not to discharge the toner to a recording medium.

15. The image forming apparatus according to claim 7, wherein the developing device includes an IC chip to store information about a toner type inside the developing device, the toner container includes another IC chip to store information about a toner type inside the toner container, the image forming apparatus further comprises a toner type information detector to detect the IC chip of the developing device and the another IC chip of the toner container, and to acquire the information about the toner type inside the developing device and the information about the toner type inside the toner container, and the controller is configured not to perform an image forming operation when the information about the toner type inside the developing device and the information about the toner type inside the toner container do not match a toner type information stored in the image forming apparatus.

16. The image forming apparatus according to claim 7, wherein the first conveyer is not detached from the image forming apparatus when the different toner is used.

17. The image forming apparatus according to claim 7, further comprising a toner container drive motor to rotate the toner container.

18. The image forming apparatus according to claim 7, further comprising a replenishment screw to convey the toner inside the temporary reservoir to the developing device.

* * * * *